US005390748A

United States Patent [19]

Goldman

[11] Patent Number: 5,390,748

[45] Date of Patent: Feb. 21, 1995

[54] METHOD AND APPARATUS FOR DRILLING OPTIMUM SUBTERRANEAN WELL BOREHOLES

[76] Inventor: William A. Goldman, 14230 Wunderlich Rd., No. 160, Houston, Tex. 77069

[21] Appl. No.: 134,747

[22] Filed: Nov. 10, 1993

[51] Int. Cl.[6] ..... E21B 44/00

[52] U.S. Cl. ..... 175/24; 175/40

[58] Field of Search ..... 175/24–27, 175/38, 40, 45, 48, 50

[56] References Cited

U.S. PATENT DOCUMENTS 4,407,017 9/1983 Zhilikov et al. ..... 175/24 X 4,606,415 8/1986 Gray, Jr. et al. ..... 175/24

5,318,136 6/1994 Rowsell et al. ..... 175/24

*Primary Examiner*—Michael Powell Buiz

*Attorney, Agent, or Firm*—William C. Norvell, Jr.

[57] ABSTRACT

A method and apparatus are provided for drilling a borehole through formations of the earth to a targeted position relative to the entrance of the borehole on the surface of the earth. At each measurement of the position and orientation of the downhole drilling mechanism, the system controller determines a new optimum path to the target and commands the drilling apparatus to produce this optimum path. Different criteria may determine the optimum path. The preferred criterion is the path of minimum tortuosity.

25 Claims, 9 Drawing Sheets

METHOD AND APPARATUS FOR DRILLING OPTIMUM SUBTERRANEAN WELL BOREHOLES

BACKGROUND OF THE INVENTION

1. Field of the Invention

This invention relates to a method and apparatus for drilling optimum boreholes in the earth, to methods for calculating such optimum boreholes, and to methods and apparatus for drilling such boreholes having minimum tortuosity.

2. Description of the Prior Art

Drilling non-vertical boreholes in the earth to reach one or more points under the surface of the earth containing petroleum is common practice today. However, even with modem techniques and apparatus, the borehole is not an optimum trajectory to the particular subsurface point.

The actual trajectory may differ greatly from the planned trajectory. The path may be long and tortuous so that the length of the hole and the drill string friction are greatly increased.

The human controlling the drilling apparatus may use measurement-while-drilling apparatus ("MWD") to determine the drill bit location. The human may then use a simple nomograph to project the drilling parameters. Last, the human makes adjustments to the drilling apparatus using experience to correct for uncalculated and unmeasured but important parameters.

Basically, the process is somewhat analogous to a human trying to point a rifle to hit a known target but not knowing the direction of the wind or exactly the path the bullet will take. The rifleman could do much better if the rifleman knew the location and heading of the bullet at each measurement and could change the bullet's direction. Then the rifleman could direct the bullet along the optimum path to the target.

To drill a borehole meeting a specific criterion requires adjustments immediately after receiving the measurement-while-drilling data. A human cannot make the necessary calculations quickly enough to determine the correct drilling apparatus instructions considering the huge amount of data and the difficulty of the calculations.

Last, some characteristics of the trajectory are so important, that those characteristics form the criteria to judge the optimum path. One such characteristic is the tortuosity of the path. One large petroleum company has suggested paying the drilling contractor based on minimizing tortuosity. This is further discussed in Increasing Extended-reach Capabilities Through Wellbore Profile Optimization, Banks, S. M., Hogg, T. W., Thorogood, J. L., Drilling Conference—Proceedings Drill Conference Proceedings, Society of Petroleum Engineers of AIME, Richardson, Tex., USA. p 85–90, 1992.

Prior methods have included hand calculations, nomograph and computer programs to calculate the planned drilling paths. Literature in which others have discussed methods of general calculation principles are as follows:

An Improved Method for Computing Directional Surveys, Wilson, G. J., Journal of Petroleum Technology, 871–876, August 1968;

Computerized Well Planning for Directional Wells, Hodgson, H., Varnado, S. G., Paper SPE 12071, 58th Annual Technical Conference, Society of Petroleum Engineers, Published by Society of Petroleum Engineers of AIME, Richardson, Tex., USA, 1983;

Evaluating and Planning Directional Wells Utilizing Post Analysis Techniques and a Three Dimensional Bottom Hole Assembly Program, Paper SPE 8339, 54th Annual Technical Conference, Society of Petroleum Engineers, Published by Society of Petroleum Engineers of AIME, Richardson, Tex., USA, 1979; and Applied Drilling Engineering, Bourgoyne, A. T., Jr., Millheim, K. K., Chenevert, M. E., Young, F. S., Jr., Society of Petroleum Engineers, Richardson, Tex., 353–359,366–372, 1986.

The applicant herein has published methods of directional well planning in three dimensions in:

Directional Well Planning with Multiple Targets in Three Dimensions, Goldman, W. A., Paper SPE 18791, California Regional Meetings, Society of Petroleum Engineers, Published by Society of Petroleum Engineers of AIME, Richardson, Tex., USA, 1989; and Artificial Intelligence Enhances Directional Control, Goldman, W. A., 65 Petroleum Engineer International 15–22, February 1993, the text of each such reference being incorporated herein by reference for all purposes.

The applicant in Artificial Intelligence Enhances Directional Control, Goldman, W. A., 65 Petroleum Engineer International 15–22, February 1993 presented the algorithm for a survey driven trajectory planning system and discussed the capability of an automated system. That article also discusses the three dimensional bit walk calculations.

Other prior art literature in the area are the following articles: Increasing Extended-Reach Capabilities Through Wellbore Profile Optimization, Banks, S. M., Hogg, T. W., Thorogood, J. L., Drilling Conference—Proceedings Drill Conference Proceedings, Published by Society of Petroleum Engineers of AIME, Richardson, Tex., USA, p 85–90, 1992; and Relief Well Technology Can Solve Ordinary Problems, Wright, J., Oil and Gas Journal, 30–33, Jan. 18, 1993. Magnetic Ranging Tool Accurately Guides Replacement Well, Lane, J. B., Wesson, J. P., Oil and Gas Journal, 96–99, 21 Dec. 21, 1993.

Applicant is not aware of any references which discuss automated control using measurement-while-drilling telemetry data while drilling nor the direct control of the drilling apparatus based on the measurement-while-drilling telemetry data, much less following an optimum path, except applicant in Artificial Intelligence Enhances Directional Control, Goldman, W. A., 65 Petroleum Engineer International 15–22, February 1993. Further, a method to minimize borehole tortuosity has not heretofore been known in the drilling industry.

A new and more efficient method of drilling boreholes from the surface to a subsurface point along the optimum trajectory is needed. Solutions to the optimization three dimensional drilling problem considering bit walk and other unknown subsurface anomalies are needed but before this invention were unavailable. Further, the importance of minimizing tortuosity needs to be a key part of the optimization process. This invention addresses such prior needs.

SUMMARY OF THE INVENTION

A method and apparatus for the drilling of a borehole with a drilling mechanism is provided. The drilling mechanism includes a drill bit having an orientable bit drilling face, which may be either a solid, such as the face of a diamond bit, or which may be fluid, such as a high velocity flow of liquid through one or more jets.

The bit drilling face is secured immediate to the distal end of a drilling conduit, which may be a series of sections of drill string, continuous coiled tubing, solid cable, or the like, which is inserted through formations of the earth to a targeted position relative to the entrance to the well borehole on the surface of the earth.

In the method, means are provided at the surface of the earth for manipulating the drilling mechanism and the drilling conduit. Means also are provided within the borehole for continuously sensing, converting and transmitting to a receiving means, data relating to the location and orientation of the borehole, the drilling mechanism, and the subterranean formation. Receiving means are provided for receiving from the sensing means the current orientation and position of the drilling mechanism in the wellbore, the current orientation and configuration of the wellbore, and the current subterranean formation characteristics.

The drilling conduit is inserted into the wellbore through the entrance, and includes the drilling mechanism carried thereon or thereby. The current orientation and position in the wellbore of the drilling mechanism, the orientation and configuration of the borehole, and the current subterranean formation characteristics are sensed and converted to downhole acoustic or radio frequency, or fiber optic, or the like signals, determined by the sensing means. The acoustic or radio frequency signals are transmitted through telementary means to the earth's surface and are converted at the surface of the earth to control signals for adjusting the orientation of the bit drilling face, whereby any such adjustment results in the borehole being at an optimum trajectory from the entrance to the wellbore to any targeted position below the surface of the earth.

DESCRIPTION OF THE PREFERRED EMBODIMENT

Figure 1:
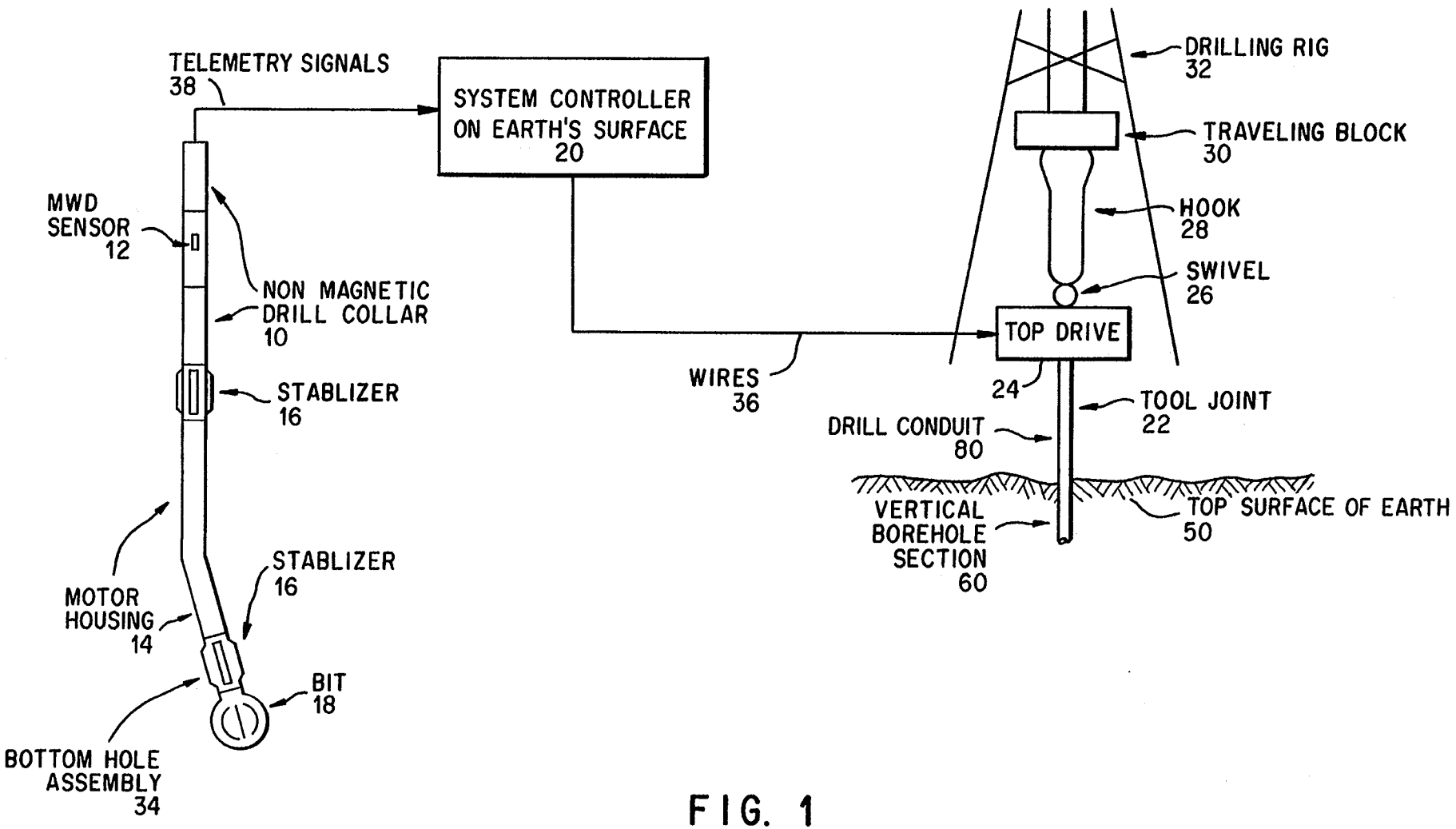
FIG. 1 is an overall graphical representation of the drilling system of this invention.

With first reference to FIG. 1, part of the AUTOMATED DRILLING SYSTEM 1 is on the TOP SURFACE OF EARTH 50 and part is beneath the TOP SURFACE OF EARTH 50. The oil containing region, the TARGET 70 (FIG. 1*a*) is not directly below the AUTOMATED DRILLING SYSTEM 1, but off to the side. The AUTOMATED DRILLING SYSTEM 1 must drill a borehole resulting in an optimum path from the entrance 68 on the earth's surface to the TARGET 70 oil containing region.

Figure 1A:
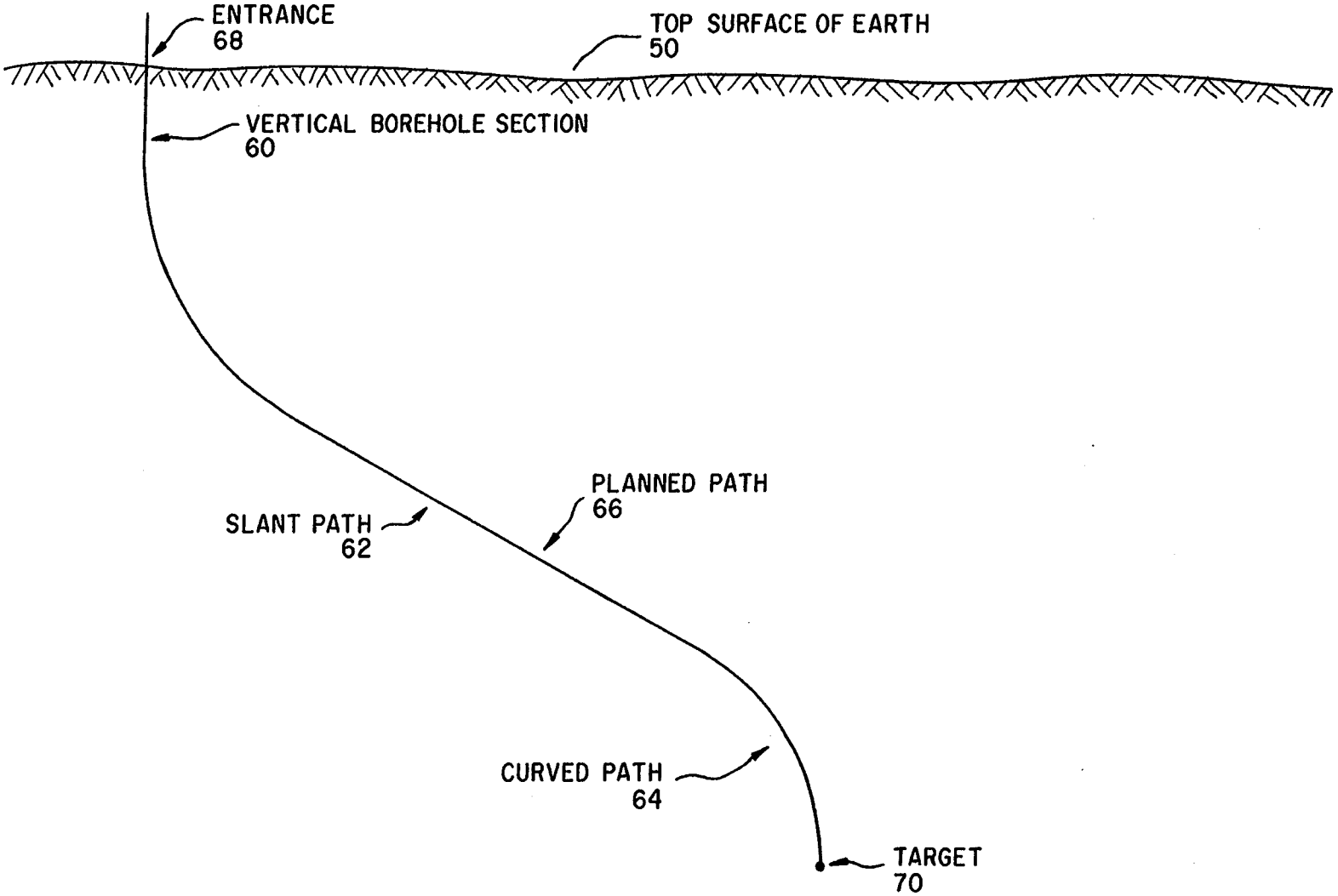
FIG. 1*a* is a graphical depiction of the planned path of the borehole from the entrance to the target.

As shown in FIGS. 1 and 1*a*, the AUTOMATED DRILLING SYSTEM 1 starts at the top surface of the earth 50, drilling a vertical borehole section 60. At some point below the surface, the planned path 66 is changed somewhat gradually from vertical 60 to a slant path 62. Then the slant path 62 may be drilled (somewhat) straight for a while. Last, the planned path 66 may be curved, such as at curve 64, to reach the target 70.

When the drilling operation begins, the location of the automated drilling system 1 and the target 70 are known. The OPTIMUM PATH 310 (FIG. 6) to the target 70 is computed.

Drilling now may begin. The ACTUAL PATH 300 in FIG. 6 to the target will be different for a variety of reasons. The bit may wander because it rotates, the earth's gravity pulls the drill string down, the earth is not uniform but is heterogeneous, the bit assembly is rotated, etc.

The MEASUREMENT-WHILE-DRILLING SENSORS 12 in FIG. 1 sends signals to the surface 50 at distinct time intervals or may send signals continuously. The drill operator must recompute the new path to the target, a difficult computation based on the received signals from the measurement-while-drilling system. Then using experience, the drill operator must change the orientation of the BOTTOM HOLE ASSEMBLY 34 in FIG. 1 to drill in the new path. A human operator just cannot incorporate the information about the path drilled into the new path. The human is simply overloaded with information and cannot process it.

Figure 6:
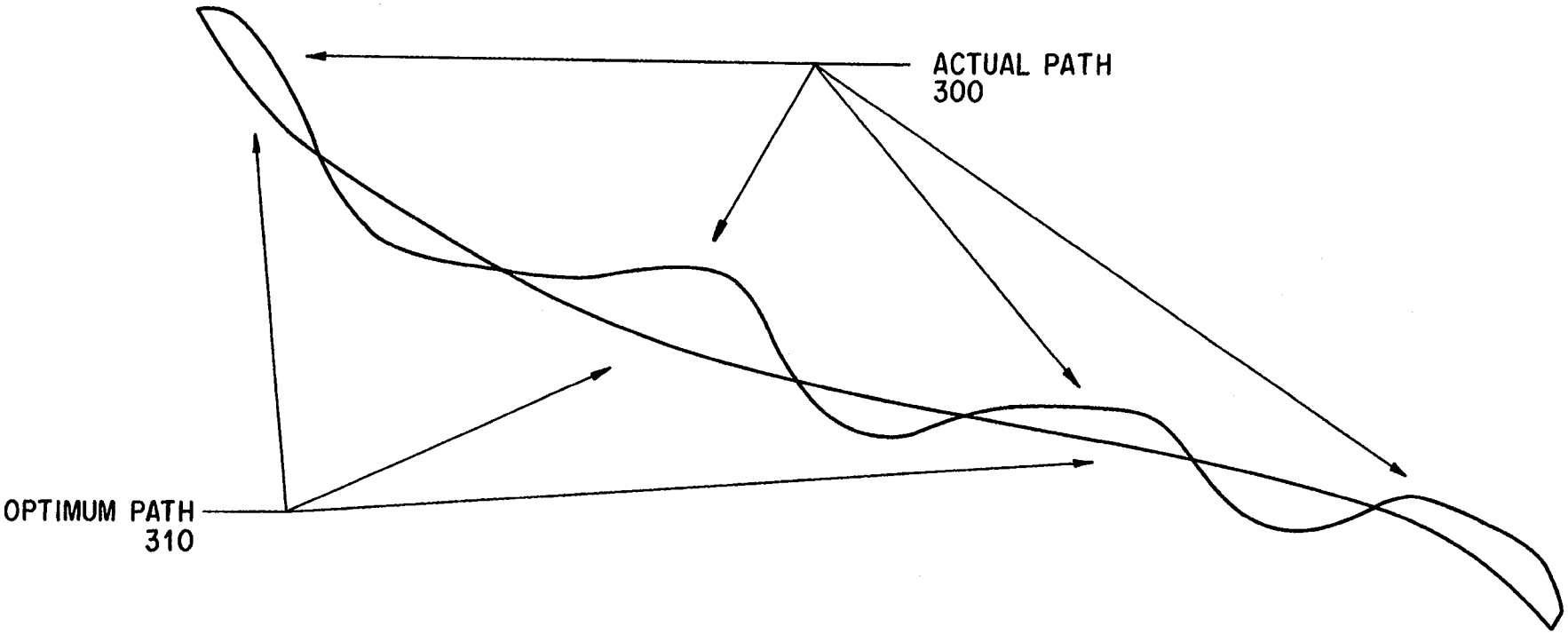
FIGS. 6 and 7 each define and illustrate tortuosity.
Figure 7:
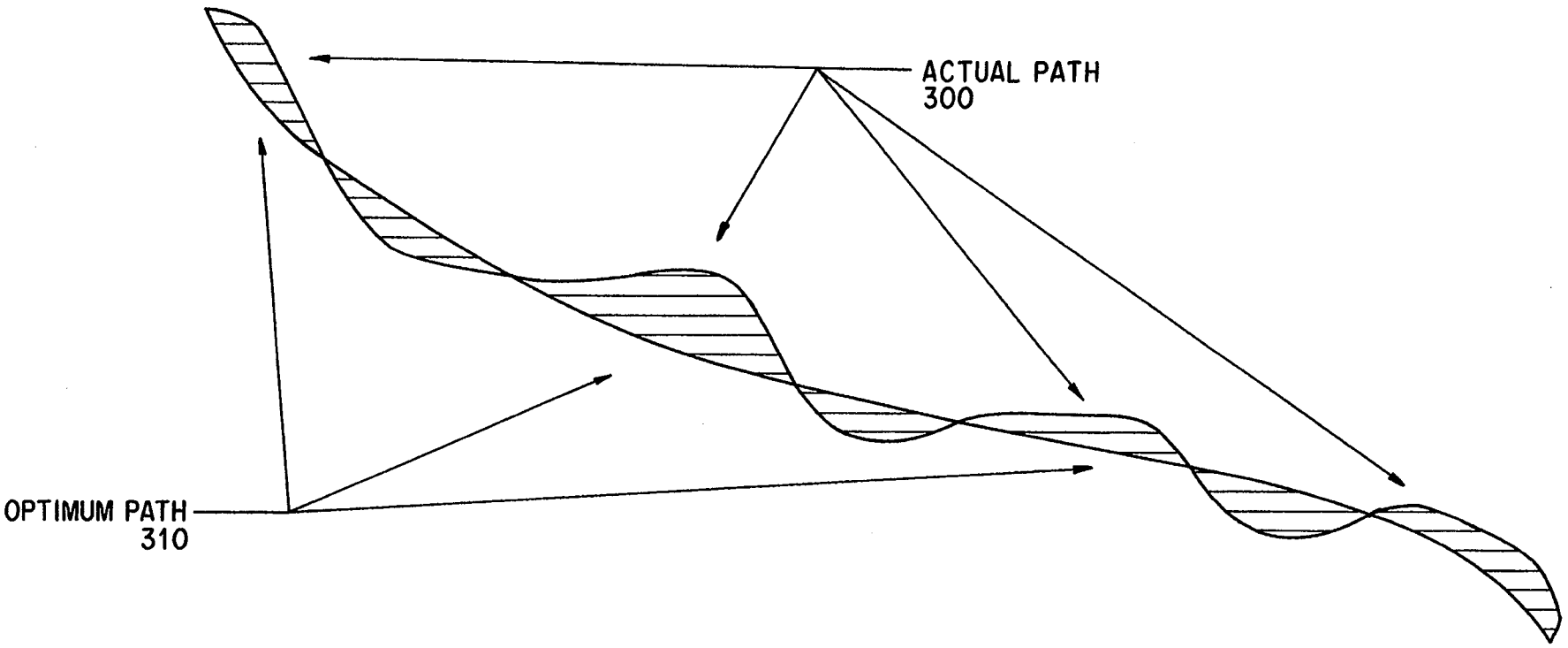

This causes the actual path 300 in FIG. 6 to wobble and stray further from the optimum path 310. By processing this information in the system controller 20, the optimum path 310 to the target 70 can be obtained notwithstanding the rotating bit 18, heterogeneous earth, gravity and rotated bit assembly, etc.

The basic automated system controller 20 in FIG. 1 controlling the tortuosity of the surface of the earth to drilled path from the subsurface target path will be described first. Then, the method of calculating the optimum path 310 to minimize the tortuosity will be described and applied to the basic automated system controller 20.

The system controller 20 requires a measure of tortuosity. Tortuosity means something winding or twisting. The system controller has data from the measured-while-drilling sensors 12 and drill conduit length to use many different measures of tortuosity. FIG. 6 gives one measure of tortuosity. An alternate measurement might be the sum of all increments of curvature minus the planned curvature along the borehole divided by the length of the borehole. The choice of measure of tortuosity depends on the person planning the drilling operation.

The basic automated drilling system 1 shown in FIG. 1 consists of a bottom hole assembly 34, a system controller 20 on the top surface of the earth 50, a top drive 24, and a Drilling rig 32 containing a traveling block 30, hook 28 and swivel 26. The bottom hole assembly 34 is connected mechanically with the tool joint 22 to form a drill conduit from the top drive 24 to the bottom hole assembly 34.

The BOTTOM HOLE ASSEMBLY 34 contains MEASUREMENT-WHILE-DRILLING SENSORS 12 that determine the orientation of the BOTTOM HOLE ASSEMBLY 34 by measuring the earth's magnetic field. The earth's magnetic field is converted to electrical signals and further converted to acoustic or electromagnetic waves, or the like. The measurement-while-drilling system transmits these acoustic or electromagnetic waves as telemetry signals 38. The word "telemetering" means sending downhole measured data to the surface, either as acoustic or electromagnetic waves without any specific grinding materials, or with some such grinding mechanism such as fiber optics, co-axial cable, wave guide, etc. The SYSTEM CONTROLLER 20 at the surface of the earth receives, detects and converts these waves again to electrical signals that represent the orientation and heading of the drill bit. The system controller 20 at the surface of the earth also receives the drilling conduit length.

The SYSTEM CONTROLLER 20 further converts the electrical signals into different electrical signals called output signals. The SYSTEM CONTROLLER 20 sends these output signals to the TOP DRIVE 24 by WIRES 36. These output signals command the TOP DRIVE 24 to produce the optimum orientation of the BOTTOM HOLE ASSEMBLY 34.

Essentially, the SYSTEM CONTROLLER 20 converts and processes the earth's magnetic field as sensed in the BOTTOM HOLE ASSEMBLY 34 and the drilling conduit length to produce signals that command the TOP DRIVE 24 to make the drill BIT 18 follow the optimum path 310 to the target 70.

Figure 8:
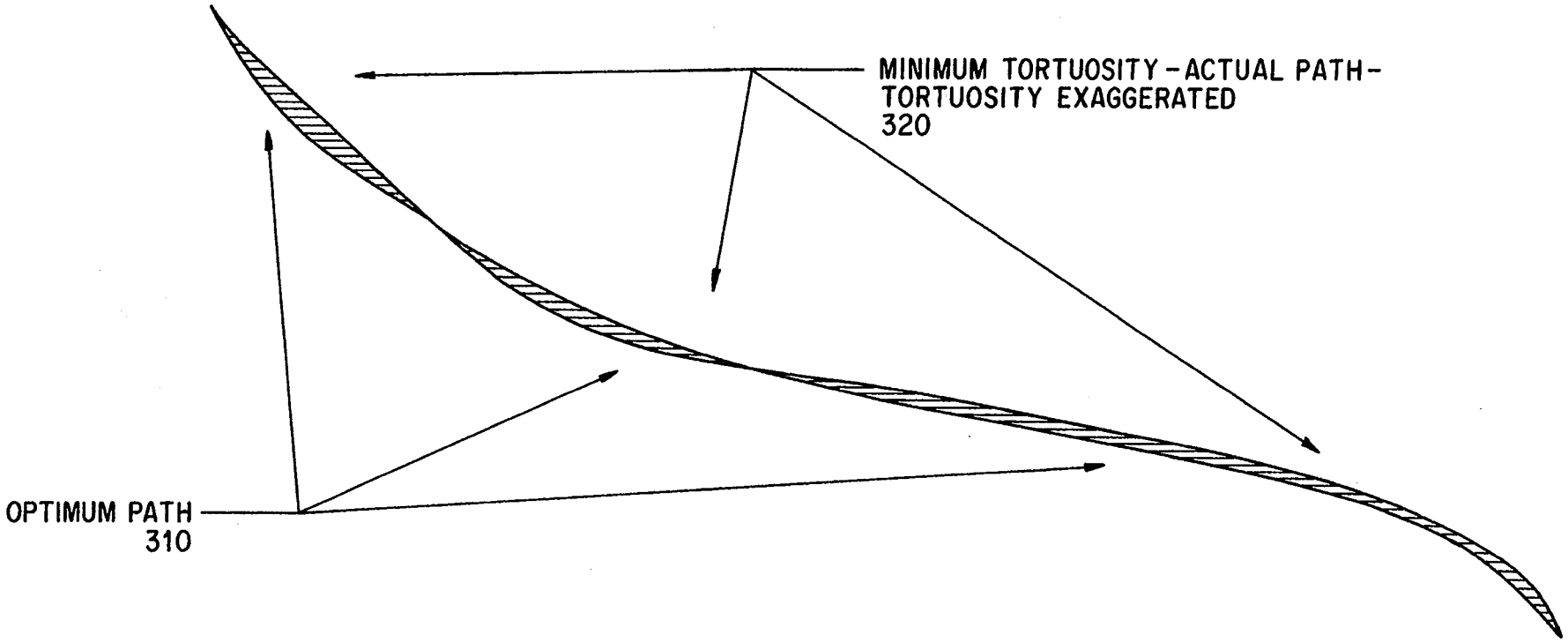
FIG. 8 illustrates a minimum tortuosity path.

The resulting path 320 still, in general, does not follow the OPTIMUM PATH 310. The effects of measurement errors, gravity, earth heterogeneities, bit walk, etc. will cause deviations. However, the SYSTEM CONTROLLER 20 only makes corrections when necessary. The resulting path 320 will still reach the target 70 but the path will have much less tortuosity. Compare 300 in FIG. 6 with 320 in FIG. 8. In addition, such a system controller minimizes wear and tear on the top drive 24.

Figure 2A:
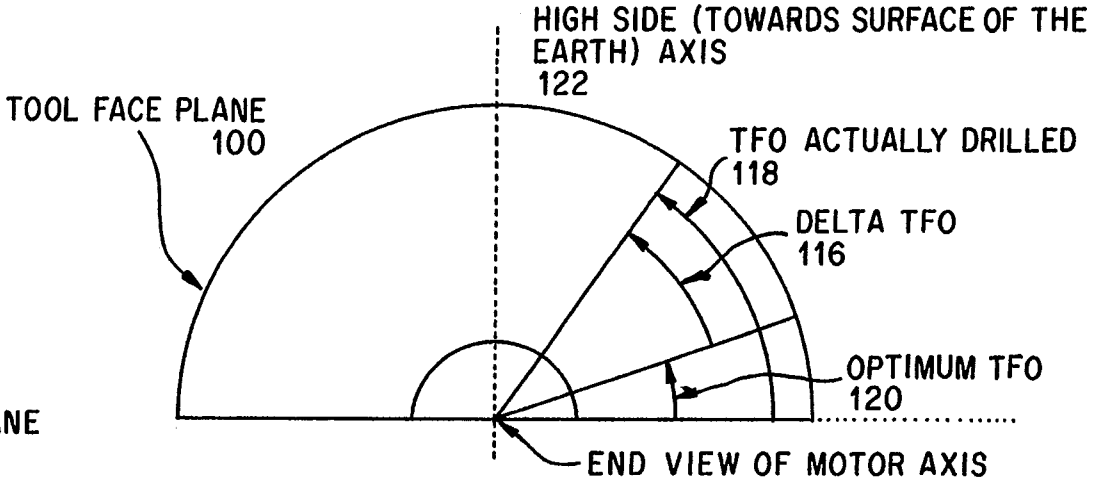
FIG. 2A is a graphical definition of tool face orientation.
Figure 2:
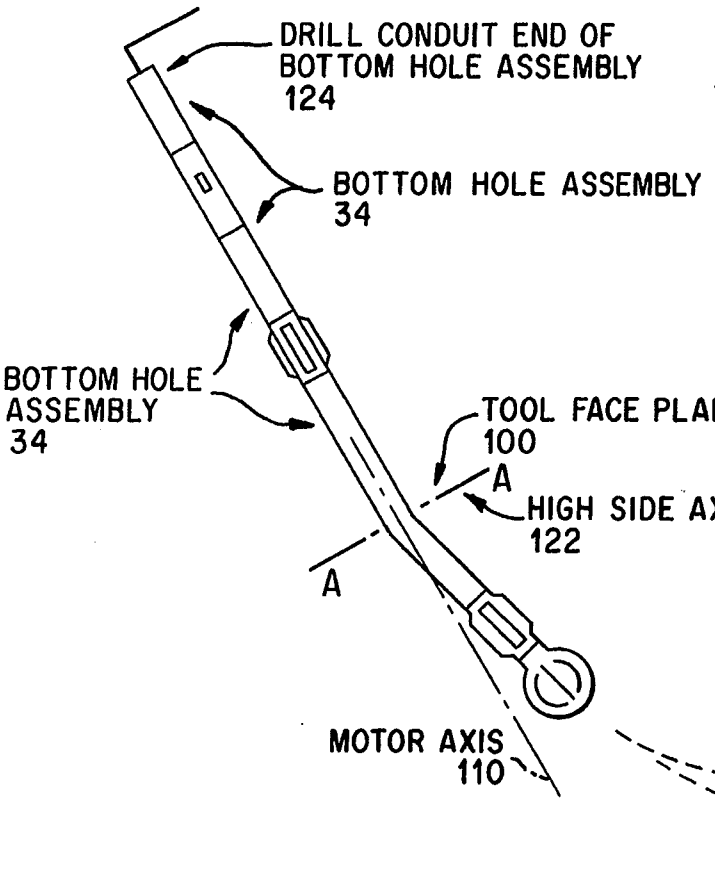
FIG. 2 is a graphical depiction of the bottom hole assembly.
Figure 3:
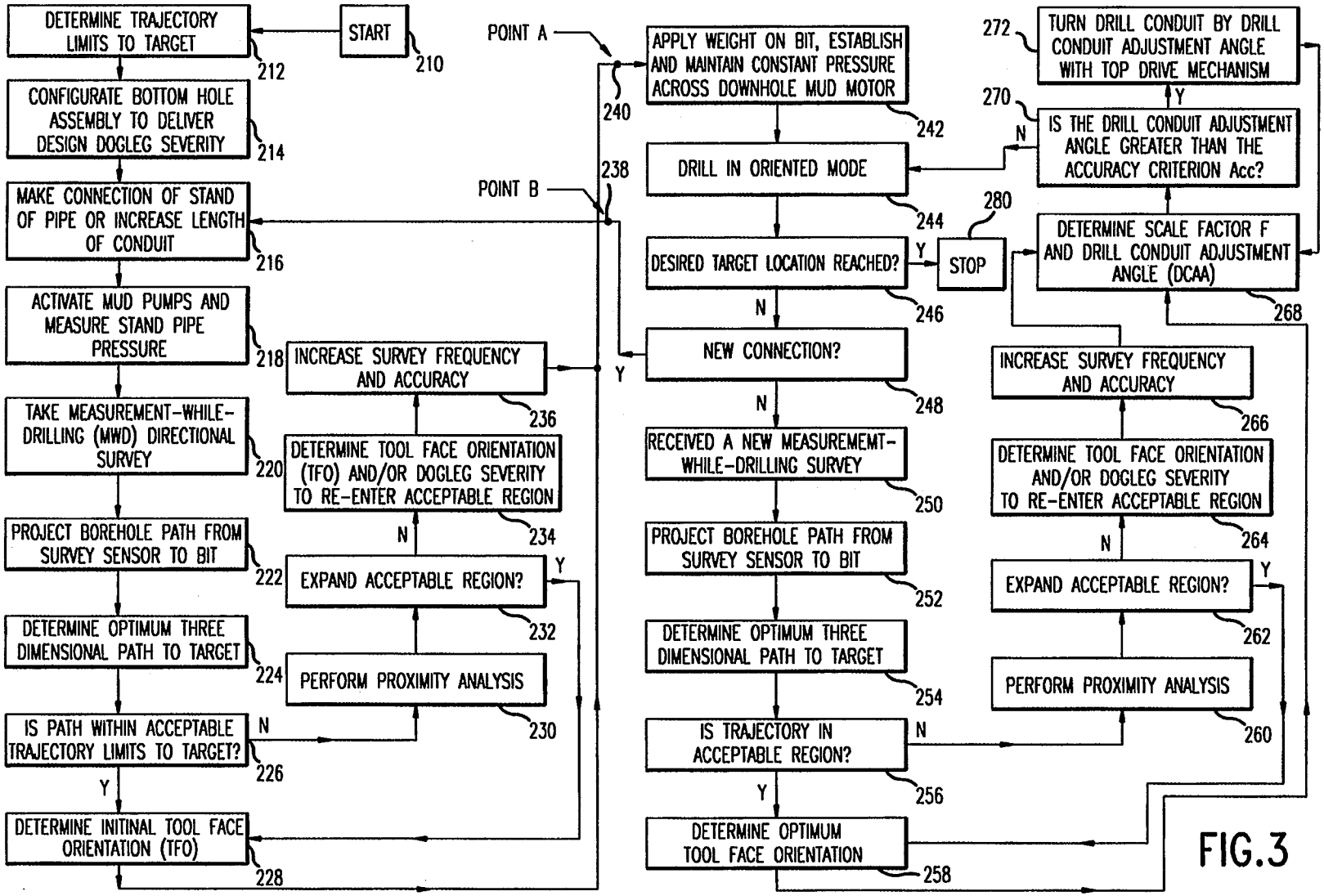
FIG. 3 is an overall block diagram of the method of the control system.

The term "tool face orientation" must now be defined. The BOTTOM HOLE ASSEMBLY 34 in FIG. 2 is attached to the drill conduit 80. To change the direction of the borehole, the drill conduit 80 is rotated at the surface of the earth. This will cause the BOTTOM HOLE ASSEMBLY 34 to rotate. Rotating the BOTTOM HOLE ASSEMBLY 34 will cause the direction of the borehole to change.

The long length, many thousands of feet, and great friction on the drill conduit 80, weight thereon in thousands of pounds, will cause a different rotation at the BOTTOM HOLE ASSEMBLY 34 than the rotation of the drill conduit 80 at the surface of the earth. The drill conduit 80 simply twists.

The MOTOR AXIS 110 in FIG. 2 is the center line of the top part of the BOTTOM HOLE ASSEMBLY 34. The TOOL FACE PLANE 100, FIG. 2A, is perpendicular to the MOTOR AXIS 110. The HIGH SIDE AXIS 122 of the TOOL FACE PLANE 100 points to the surface of the earth, Looking toward the DRILL CONDUIT END OF BOTTOM HOLE ASSEMBLY 124 of the ASSEMBLY 34, one sees the TOOL FACE PLANE 100. The TOOL FACE PLANE 100 is shown in FIG. 2A and labeled "Tool Face Orientation."

The symbol TFO stands for "Tool Face Orientation". TFO is an angle about the MOTOR AXIS 110. The angle resulting from the signals sent to the TOP DRIVE 24, twisting the drill string and BOTTOM HOLE ASSEMBLY 34 is the OPTIMUM TFO 120. The actual angle is TFO ACTUALLY DRILLED 118. The difference between TFO ACTUALLY DRILLED 118 and OPTIMUM TFO 120 defines DELTA TFO 116.

FIG. 2 shows the two paths that correspond to the OPTIMUM TFO 120 and the TFO ACTUALLY DRILLED 118. The OPTIMUM TFO 120 gives the OPTIMUM PATH 114 to the target 70. The PATH ACTUALLY DRILLED 112 results in the TFO ACTUALLY DRILLED 118.

Figure 4:
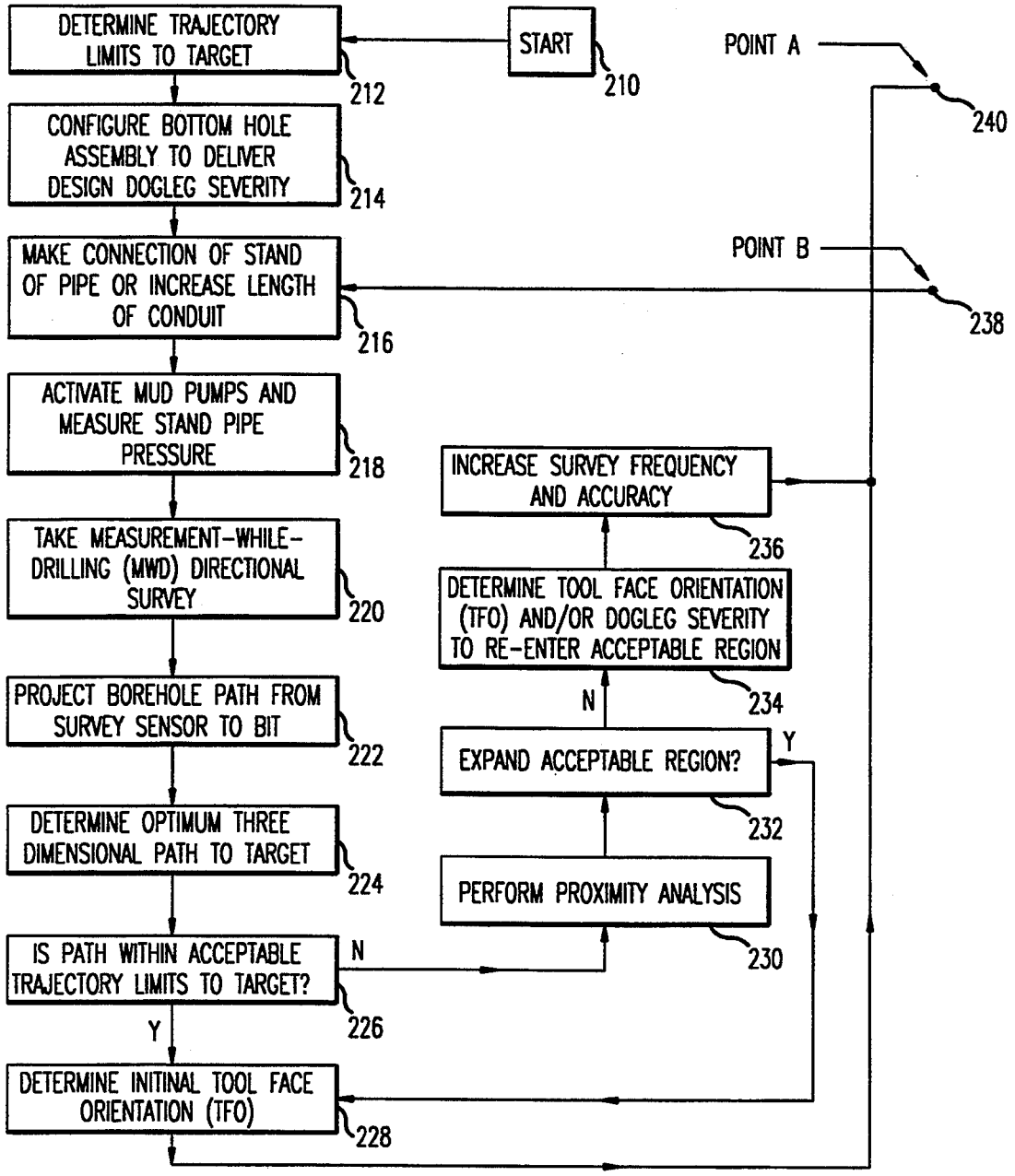
FIG. 4 is part of FIG. 3 showing the control system up to applying weight on the bit.

Now consider the process of determining the control signals sent to the TOP DRIVE 24 by the SYSTEM CONTROLLER 20 from the MEASUREMENT-WHILE-DRILLING SENSORS 12. Now referring to FIG. 4, starting at block 210, the trajectory limits are determined to the target 212. This is part of the planning process and considers other boreholes nearby that must not be hit by the new borehole. Further, Computerized Well Planning for Directional Wells, Hodgson, H., Varnado, S. G., Paper SPE 12071, 58th Annual Technical Conference, Society of Petroleum Engineers, Published by Society of Petroleum Engineers of AIME, Richardson, Tex., USA, 1983, discloses methods to determine these trajectory limits, and is incorporated herein by reference for all purposes.

After determining these trajectory limits, the appropriate bottom hole apparatus 214 is selected and a length of drilling conduit 216 is inserted into the well. At this point, the planned trajectory and the drilling equipment are known.

Next, the drilling process begins by sending control signals from the SYSTEM CONTROLLER 20 to the mud pumps establishing and measuring the standpipe or other conduit pressure 218.

The SYSTEM CONTROLLER 20 receives, detects and converts the telemetry signals 38 from the measurement-while-drilling sensors 12 to electrical signals used by the SYSTEM CONTROLLER 20 to take a measurement-while-drilling survey 220. From these data 220 the borehole path from the survey sensor to the bit 222 is projected and the optimum three dimensional path to the target 224 is then determined.

At this point, the new path 224 is compared to the trajectory limits to the target 226. If the path is not within the trajectory limits 212 previously determined, proximity analysis 230 is performed and these limits are as evaluated.

Figure 5:
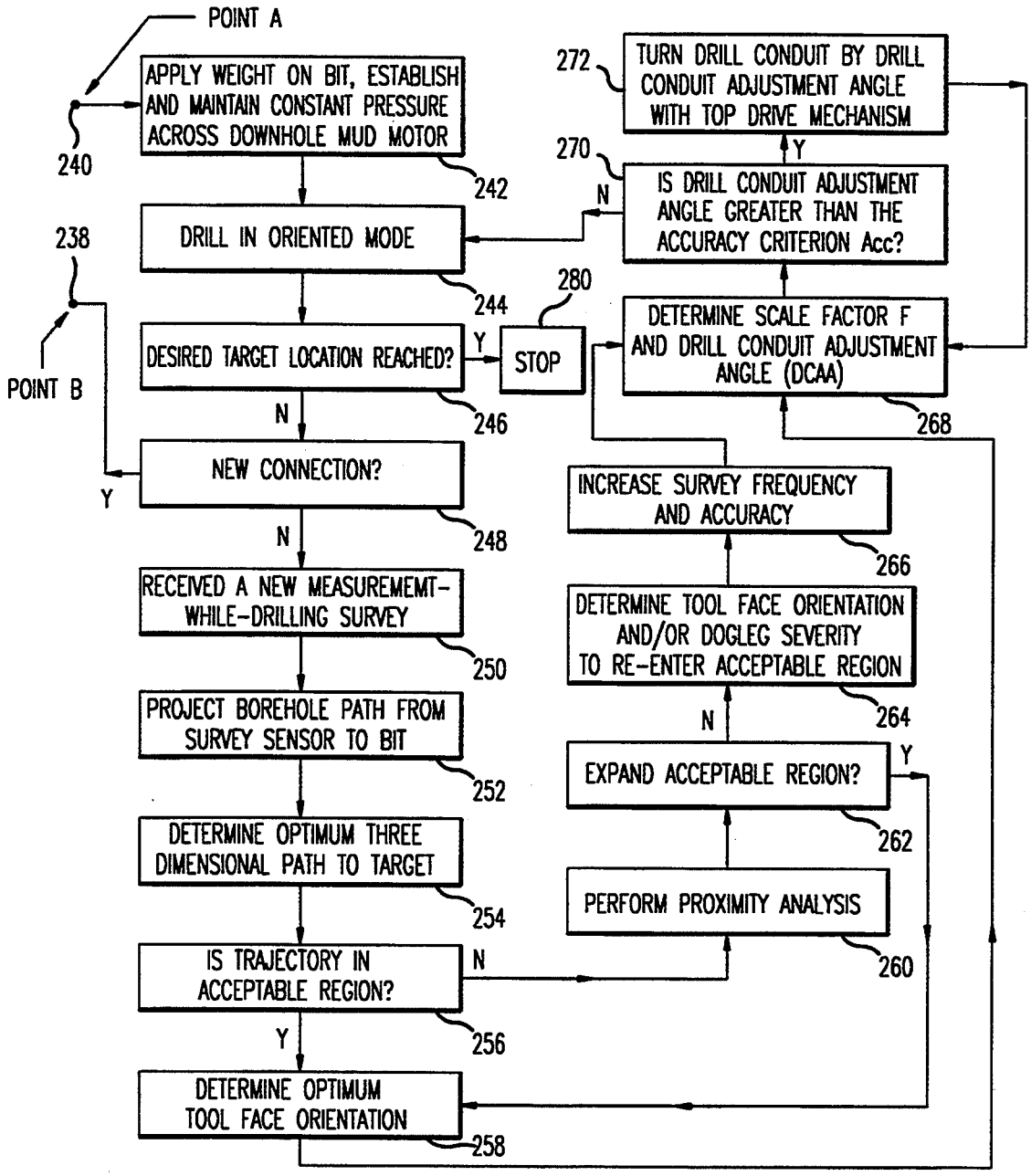
FIG. 5 is part of FIG. 3 showing the remainder of the control system from and including applying weight on the bit.

If the trajectory limits 232 can be expanded, the initial tool face orientation 228 can be determined and then continue to point A and FIG. 5. If the trajectory limits cannot be expanded, the tool face and/or dogleg severity required to reenter the acceptable region 234 is determined. The survey frequency and accuracy 236 are increased and proceed to point A on FIG. 5.

At point A on FIG. 5, a new tool face orientation, TFO, has been determined. Now the SYSTEM CONTROLLER 20 commands weight to be applied to the BIT 18 using the TRAVELING BLOCK 30. The controller establishes and maintains constant pressure across the mud motor 242. Drilling now continues in the oriented mode 244.

The SYSTEM CONTROLLER 20 evaluates the telemetry signals 38 from the MEASUREMENT-WHILE-DRILLING SENSORS 12 and determines if the borehole has reached the target 246. If the borehole has reached the target 246, the SYSTEM CONTROLLER 20 stops the drilling process 280.

If the borehole has not reached the target 246, the SYSTEM CONTROLLER 20 determines if a new connection of drill pipe or additional length of conduit is needed. If so, the SYSTEM CONTROLLER 20 commands a new connection of a new stand of pipe or length to be made via 238, 216. From block 216, the process proceeds as described previously.

If no new connection or length of drill conduit is needed, a new measurement-while-drilling acoustic or electromagnetic signal is evaluated 250.

The SYSTEM CONTROLLER 20 determines a new optimum three dimensional path to the target 252, 254. If the trajectory is in the acceptable region 256, the SYSTEM CONTROLLER 20 determines the optimum new tool face orientation 258.

If the trajectory is not in the acceptable region 256, the SYSTEM CONTROLLER 20 determines if the acceptable region can be expanded 260 and 262 in the same manner as done previously (blocks 230 and 232, above). If the region can be expanded 262, then the SYSTEM CONTROLLER determines the optimum tool face orientation 258.

If the region cannot be expanded, then the SYSTEM CONTROLLER 20 determines the tool face orientation and/or dogleg severity needed to reenter the acceptable region 264. The SYSTEM CONTROLLER 20 increases the survey accuracy and frequency 266.

If either the trajectory is in the acceptable region 256 or the region has been expanded 266, a new tool face orientation has been determined 258 or 264. Having determined a new tool face orientation 258 or increased the survey accuracy and frequency 266, the SYSTEM CONTROLLER 20 determines a scale factor F and new drill conduit adjustment angle 268. The drill conduit adjustment angle (DCAA) is the angle that the drill conduit must be twisted at the surface of the earth to set the new tool face orientation angle determined by the SYSTEM CONTROLLER in 258 or 264. The F factor is an adjustment to turn the drill conduit at the surface of the earth to set the new tool face orientation angle at the Bit 18.

If the drill conduit adjustment angle is greater than a predetermined accuracy Acc at 270, the drill conduit is turned by the TOP DRIVE 24 mechanism 272 and the SYSTEM CONTROLLER 20 sets a new scale factor F and drill conduit adjustment angle 268 until the drill conduit adjustment angle is less than the accuracy Acc 270. When the drill conduit adjustment angle is less than the accuracy Acc at 270, the SYSTEM CONTROLLER 20 continues to drill in the oriented mode 244.

Obviously, the above automated CONTROLLER SYSTEM 20 can be used as a quasiautomated controller system, a partial manual controller system or a pure manual system. The measurement-while-drilling signals could be entered into the SYSTEM CONTROLLER 20 manually and the resulting SYSTEM CONTROLLER 20 output signals used to set the TOP DRIVE 24 or equivalent mechanical system automatically as previously described. The measurement-while-drilling signals could be fed to the SYSTEM CONTROLLER 20 as described above and the SYSTEM CONTROLLER 20 output signals fed to TOP DRIVE 24 or equivalent mechanical system manually. The measurement-while-drilling signals could be entered into the SYSTEM CONTROLLER 20 manually and the SYSTEM CONTROLLER 20 output signals fed to TOP DRIVE 24 or equivalent mechanical system manually. This flexibility also allows the controller system to be used in a variety of equipment environments or when some particular piece of equipment is malfunctioning or replaced by a manual system.

Having described the entire process from start 210 to stop 280, some details of the calculations will now be discussed. The applicant's paper, Artificial Intelligence Enhances Directional Control, Goldman, W. A., 65 Petroleum Engineer International 15–22, February 1993, provides the basic background to determining the bit walk calculations and will not be repeated here, but is incorporated herein for all purposes.

The SYSTEM CONTROLLER 20 determines an initial tool face orientation (TFO) 228 by subtracting an estimate of the Angular Reactive Torque from the geometric TFO. The geometric TFO is the TFO that would drill the optimum path under ideal conditions, that is, without any outside influences, such as gravity friction, bit rotation, and other errors.

Initial TFO = Geometric TFO − Angular Reactive Torque.

The SYSTEM CONTROLLER 20 determines the estimate of the Angular Reactive Torque by obtaining the initial actual TFO from the measurement-while-drilling system with the BIT 18 off bottom. Then the SYSTEM CONTROLLER 20 applies weight on the BIT 18 and noting the new measurement-while-drilling actual TFO:

Angular Reactive Torque = final actual TFO − initial actual TFO.

The value of the pressure differential across the mud motor is measured by noting the drilling conduit pressure with the BIT 18 off bottom, SPP 1 and the pressure when the motor is on bottom and running, SPP2:

delta P = SPP2 − SPP1.

The SYSTEM CONTROLLER 20 determines the drill conduit adjustment angle (DCAA) by:

DCAA = (optimum TFO − actual TFO) × F.

F is a multiplier that may be set to 1.0 initially but can be estimated based on past performance for the next step by:

$$F = \frac{\text{total } DCAA \text{ required for optimum } TFO}{(\text{optimum } TFO - \text{actual } TFO)} \quad - \text{last}$$

where the optimum and the actual TFO as indicated are from the previous adjustment.

The SYSTEM CONTROLLER 20 compares the absolute value of DCAA with the desired accuracy Acc that is typically 3 to 10 degrees. If the absolute value of DCAA is less than Acc, then the TFO is not adjusted. Making this choice of TFO and DCAA minimizes borehole tortuosity and twist and also minimizes drill string friction.

The SYSTEM CONTROLLER 20 determines the optimum TFO by first determining a delta TFO:

Define TFO Previous as the Previous Optimum TFO.

delta TFO=TFO ACTUALLY DRILLED−TFO PREVIOUS.

Define MD as measured drill depth. Then define delta MD as the difference between adjacent MD's. Then define borehole twist by:

borehole twist=delta TFO/delta MD.

Borehole twist is an estimate of the slope of TFO as a function of measured drill depth. Alternately, the borehole twist could be estimated by averaging borehole twist over the last few or all of the last values of borehole twist.

The SYSTEM CONTROLLER 20 determines the optimum delta TFO by:

optimum delta TFO=borehole twist×expected MD drilled/2.

The SYSTEM CONTROLLER 20 next determines the optimum TFO by determining the geometric TFO corresponding to the new optimum path and subtracting the optimum delta TFO:

optimum TFO=geometric TFO−optimum delta TFO.

This optimum TFO is marked 120 in FIG. 2A.

Determining the optimum path in real time is an integral part of the controller. That calculation could be done in a programmable digital computer or by some other apparatus and included as a part of the SYSTEM CONTROLLER 20 at the surface or the top drive controller 24 the BOTTOM HOLE ASSEMBLY 34. The invention foresees the use of the calculation as a method of receiving signals that represent the position and orientation of the BOTTOM HOLE ASSEMBLY 34, determining the optimum orientation and heading of the BOTTOM HOLE ASSEMBLY 34, converting those calculations to signals that control the BOTTOM HOLE ASSEMBLY 34 orientation and heading.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modification are contemplated which can be made without departing from the spirit of the described invention.

What is claimed and desired to be secured by Letters Patent is:

1. A method of drilling a borehole through formations of the earth, to a targeted position relative to the entrance to the well at the surface of the earth with a drilling mechanism including a drill bit having an orientable bit drilling face secured immediate the distal end of a drilling conduit, comprising the steps of:

a. providing:
   (i) means at the surface of the earth for manipulating the drilling conduit, the drilling mechanism, and the drill bit;
   (ii) means within the borehole for continuously sensing, converting, and telemetering to a receiving means data relating to the location and orientation of the borehole and the drilling mechanism;
   (iii) receiving means for continuously receiving from the sensing means the current orientation and location of the drilling mechanism, and the current orientation and location of the borehole;
b. inserting into the borehole through said entrance a drilling conduit including the drilling mechanism and the drill bit;
c. continuously sensing the current orientation and position in the borehole of the drilling mechanism, and the orientation and location of the borehole;
d. continuously converting to downhole acoustic or radio frequency signals the continuously sensed data in step "c";
e. transmitting the acoustic or radio frequency signals through the telemetry means to the earth's surface; and
f. converting at the surface of the earth the telemetry signals received by the receiving means to control signals for re-orientation of the bit drilling face, whereby any such re-orientation results in the borehole being drilled at an optimum trajectory from the entrance to the borehole to any targeted position below the surface of the earth.

2. A method of drilling a borehole through formations of the earth, to a targeted position relative to the entrance to the well or hole on the surface of the earth with a drilling mechanism including a drill bit having an orientable bit drilling face secured immediate the distal end of a drilling conduit, comprising the steps of:

a. providing:
   (i) means at the surface of the earth for manipulating the drilling conduit, the drilling mechanism, and the drill bit;
   (ii) means within the borehole for intermittently sensing, converting, and telemetering to a receiving means data relating to the location and orientation of the borehole and the drilling mechanism;
   (iii) receiving means for intermittently receiving from the sensing means the current orientation and location of the drilling mechanism, and the current orientation and location of the borehole;
b. inserting into the borehole through said entrance a drilling conduit including the drilling mechanism and the drill bit;
c. intermittently sensing the current orientation and position in the borehole of the drilling mechanism, and the orientation and location of the borehole;
d. intermittently converting to downhole acoustic or radio frequency signals the intermittently sensed data in step "c";
e. transmitting the acoustic or radio frequency signals through the telemetry means to the earth's surface; and
f. converting at the surface of the earth the telemetry signals received by the receiving means to control signals for re-orientation of the bit drilling face, whereby any such re-orientation results in the borehole being drilled at an optimum trajectory from the entrance to the borehole to any targeted position below the surface of the earth.

3. A method of drilling a borehole through formations of the earth, to a targeted position relative to the entrance to the well at the surface of the earth with a drilling mechanism including a drill bit having an orientable bit drilling face secured immediate the distal end of a drilling conduit, comprising the steps of:

a. providing:
   (i) means at the surface of the earth for manipulating the drilling conduit, the drilling mechanism, and the drill bit;
   (ii) means within the borehole for sensing, converting, and telemetering to a receiving means data relating to the location and orientation of the borehole and the drilling mechanism;
   (iii) receiving means for receiving from the sensing means the current orientation and location of the drilling mechanism, and the current orientation and location of the borehole;
b. inserting into the borehole through said entrance a drilling conduit including the drilling mechanism and the drill bit;
c. sensing the current orientation and position in the borehole of the drilling mechanism, and the orientation and location of the borehole;
d. converting to downhole acoustic or radio frequency signals the sensed data in step "c";
e. transmitting the acoustic or radio frequency signals through the telemetry means to the earth's surface; and
f. converting at the surface of the earth the telemetry signals received by the receiving means to control signals for re-orientation of the bit drilling face, whereby any such re-orientation results in the borehole being drilled at an optimum trajectory from the entrance to the borehole to any targeted position below the surface of the earth.

4. The method of claim 1, claim 2, or claim 3 wherein the drilling mechanism includes at least one nozzle for projecting a high velocity jet stream of drilling fluid to thereby provide the orientable bit drilling face.

5. The method of claim 1, claim 2, or claim 3 wherein the drilling mechanism includes a mud motor disposed on said drilling conduit for converting pressurized fluid within the conduit for transmitting directional forces to the drill bit.

6. The method of claim 1, claim 2, or claim 3 wherein the telemetry means is a measurement-while-drilling system.

7. The method of claim 1, claim 2, or claim 3 wherein the sensing means senses, converts, and transmits to the receiving means the azimuth, inclination, and tool face orientation in conjunction with the drilling conduit length.

8. The method of claim 1, claim 2, or claim 3 wherein the sensing means senses, converts, and transmits to the receiving means data related to and which can be converted to and from, but are not, the azimuth, inclination, and/or tool face orientation and the drilling conduit length.

9. The method of claim 1, claim 2, or claim 3 wherein the sensing means senses, converts, and transmits to the receiving means data which is equivalent to the azimuth, inclination, tool face orientation, and the drilling conduit length.

10. The method of claim 1, claim 2, or claim 3 wherein the optimum trajectory minimizes some measure of tortuosity along the trajectory from the borehole entrance to the targeted position below the surface of the earth.

11. The method of claim 1, claim 2, or claim 3 wherein the drilling apparatus manipulation occurs at the bottom of the borehole.

12. The method of claim 1, claim 2, or claim 3 wherein the means within the borehole for sensing, converting and telemetering to a receiving means generates data at discrete points of time, with the time point increments between any two adjacent points being sufficiently small so as to reconstruct such sensed, converted and telemetered data with negligible difference from the measured data.

13. A method of drilling a borehole through formations of the earth, to a targeted position relative to the entrance to the well at the surface of the earth with a drilling mechanism including a drill bit having an orientable bit drilling face secured immediate the distal end of a drilling conduit, comprising the steps of:

a. providing:
   (i) means at the surface of the earth for manipulating the drilling conduit, the drilling mechanism, and the drill bit;
   (ii) means within the borehole for sensing, converting, and telemetering to a receiving means data relating to the location and orientation of the borehole and the drilling mechanism;
   (iii) receiving means for receiving from the sensing means the current orientation and location of the drilling mechanism, and the current orientation and location of the borehole;
b. inserting into the borehole through said entrance a drilling conduit including the drilling mechanism and the drill bit;
c. sensing the current orientation and position in the borehole of the drilling mechanism, and the orientation and location of the borehole;
d. converting to downhole acoustic or radio frequency signals the sensed data in step "c";
e. transmitting the acoustic or radio frequency signals through the telemetry means to the earth's surface; and
f. converting at the surface of the earth the telemetry signals received by the receiving means to control signals for re-orientation of the bit drilling face, and the length of the drilling conduit within the borehole, and manually feeding such converted material to an electronic signal processor the output of which is directed to a human operator for re-orientation of the bit drilling face, whereby any such re-orientation results in the borehole being drilled at an optimum trajectory from the entrance to the borehole to any targeted position below the surface of the earth.

14. A method of drilling a borehole through formations of the earth, to a targeted position relative to the entrance to the well at the surface of the earth with a drilling mechanism including a drill bit having an orientable bit drilling face secured immediate the distal end of a drilling conduit, comprising the steps of:

a. providing:
   (i) means at the surface of the earth for manipulating the drilling conduit, the drilling mechanism, and the drill bit;
   (ii) means within the borehole for sensing, converting, and telemetering to a receiving means data relating to the location and orientation of the borehole and the drilling mechanism;
   (iii) receiving means for receiving from the sensing means the current orientation and location of the drilling mechanism, and the current orientation and location of the borehole;

b. inserting into the borehole through said entrance a drilling conduit including the drilling mechanism and the drill bit;

c. sensing the current orientation and position in the borehole of the drilling mechanism, and the orientation and location of the borehole;

d. converting to downhole acoustic or radio frequency signals the sensed data in step "c";

e. transmitting the acoustic or radio frequency signals through the telemetry means to the earth's surface; and f. converting at the surface of the earth the telemetry signals received by the receiving means to control signals for re-orientation of the bit drilling face, and the length of the drilling conduit within the borehole, and automatically feeding such converted material to an electronic signal processor the output of which is directed to a human operator for adjustment, whereby any such re-orientation of the bit drilling face results in the borehole being drilled at an optimum trajectory from the entrance to the borehole to any targeted position below the surface of the earth.

15. A method of drilling a borehole through formations of the earth, to a targeted position relative to the entrance to the well or hole on the surface of the earth with a drilling mechanism including a drill bit having an orientable bit drilling face secured immediate the distal end of a drilling conduit, comprising the steps of:

a. providing:

(i) means at the surface of the earth for manipulating the drilling conduit, the drilling mechanism, and the drill bit;

(ii) means within the borehole for continuously sensing, converting, and telemetering to a receiving means data relating to the location and orientation of the borehole and the drilling mechanism;

(iii) receiving means for receiving from the sensing means the current orientation and location of the drilling mechanism, and the current orientation and location of the borehole; and (iiii) operator means for automatically receiving output electronic signals and generating second adjustment signals for re-orienting the position of the drill bit face;

b. inserting into the borehole through said entrance a drilling conduit including the drilling mechanism and the drill bit;

c. sensing the current orientation and position in the borehole of the drilling mechanism, and the orientation and location of the borehole;

d. converting to downhole acoustic or radio frequency signals the sensed data in step "c";

e. transmitting the acoustic or radio frequency signals through the telemetry means to the earth's surface; and f. automatically converting at the surface of the earth the telemetry signals received by the receiving means to control signals for orientation of the bit drilling face, and the length of the drilling conduit within the borehole, and manually feeding such converted material to an electronic signal processor the output of which is automatically directed to said operator means for adjustment, whereby any such adjustment results in the borehole being at an optimum trajectory from the entrance to the borehole to any targeted position below the surface of the earth.

16. A method of drilling a borehole through formations of the earth, to a targeted position relative to the entrance to the well or hole on the surface of the earth with a drilling mechanism including a drill bit having an orientable bit drilling face secured immediate the distal end of a drilling conduit, comprising the steps of:

a. providing:

(i) means at the surface of the earth for manipulating the drilling conduit, the drilling mechanism, and the drill bit;

(ii) means within the borehole for continuously sensing, converting, and telemetering to a receiving means data relating to the location and orientation of the borehole and the drilling mechanism;

(iii) receiving means for receiving from the sensing means the current orientation and location of the drilling mechanism, and the current orientation and location of the borehole; and (iiii) operator means for automatically receiving output electronic signals and generating second adjustment signals for re-orienting the position of the drill bit face;

b. inserting into the borehole through said entrance a drilling conduit including the drilling mechanism and the drill bit;

c. sensing the current orientation and position in the borehole of the drilling mechanism, and the orientation and location of the borehole;

d. converting to downhole acoustic or radio frequency signals the sensed data in step "c";

e. transmitting the acoustic or radio frequency signals through the telemetry means to the earth's surface; and f. automatically converting at the surface of the earth the telemetry signals received by the receiving means to control signals for orientation of the bit drilling face, and the length of the drilling conduit within the borehole, and automatically feeding such converted material to an electronic signal processor the output of which is automatically directed to said operator means for adjustment, whereby any such re-orientation results in the borehole being at an optimum trajectory from the entrance to the borehole to any targeted position below the surface of the earth.

17. An apparatus for drilling a borehole with a drilling mechanism including a drill bit having an orientable bit drilling face secured immediate the distal end of a drilling conduit, through formations of the earth, to a targeted position relative to the entrance to the borehole on the surface of the earth, comprising:

a. means at the surface of the earth for manipulating the drilling mechanism and the drilling conduit;

b. means within the borehole for sensing, converting, and telemetering to a receiving means data relating to the location and orientation of the borehole, the drilling mechanism and the subterranean formation;

c. receiving means for receiving from the sensing means the current orientation and position of the drilling mechanism in the borehole, the current orientation and configuration of the borehole, and the current subterranean formation characteristics;

d. means for converting to downhole acoustic or radio frequency signals the sensed data generated by the sensing means;

e. means for transmitting the acoustic or radio frequency signals through the telemetry means to the earth's surface; and f. means for converting at the surface of the earth the telemetry signals received by the receiving means to control signals for the orientation of the bit drilling face whereby any such re-orientation results in the borehole thereafter being at an optimum trajectory from the entrance to the borehole to any targeted position below the surface of the earth.

18. The apparatus of claim 17 wherein the drilling mechanism includes at least one nozzle for projecting a high velocity jet stream of drilling fluid to thereby provide the orientable bit drilling face.

19. The apparatus of claim 17 wherein the drilling mechanism includes a mud motor disposed on said drilling conduit for converting pressurized fluid within the conduit for transmitting directional forces to the drill bit.

20. The apparatus of claim 17 wherein the telemetry means is a measurement-while-drilling system.

21. The apparatus of claim 17 wherein the sensing means senses, converts, and transmits to a receiving means, the azimuth, inclination, and tool face orientation in conjunction with the drilling conduit length.

22. The apparatus of claim 17 wherein the sensing means senses, converts, and transmits to the receiving means data related to and which can be converted to and from, but are not the azimuth, inclination, and/or tool face orientation and drilling conduit length.

23. The apparatus of claim 17 wherein the sensing means senses, converts, and transmits to the receiving means data which is equivalent to the azimuth, inclination, tool face orientation, and the drilling conduit length.

24. The apparatus of claim 17 wherein the optimum trajectory minimizes some measure of tortuosity along with trajectory from the borehole entrance to the targeted position below the surface of the earth.

25. The apparatus of claim 17 wherein the means within the borehole for sensing, converting and telemetering to a receiving means generates data at discrete points of time, with the time point increments between any two adjacent points being sufficiently small so as to reconstruct such sensed, converted and telemetered data with negligible difference from the measured data.

* * * * *